US005398611A

United States Patent [19]

Michna et al.

[11] Patent Number: 5,398,611

[45] Date of Patent: Mar. 21, 1995

[54] LOW ENERGY BLASTING INITIATION SYSTEM, METHOD AND SURFACE CONNECTION THEREFOR

[75] Inventors: Richard J. Michna, Winsted; Anthony Sendek, Canton; J. Donaldson Thomas, East Granby, all of Conn.

[73] Assignee: The Ensign-Bickford Company, Simsbury, Conn.

[21] Appl. No.: 118,576

[22] Filed: Sep. 9, 1993

Related U.S. Application Data

[63] Continuation of Ser. No. 878,735, May 5, 1992, abandoned, which is a continuation of Ser. No. 608,993, Nov. 5, 1990, Pat. No. 5,171,935.

[51] Int. Cl.[6] ..... C06C 5/06

[52] U.S. Cl. ..... 102/275.7; 102/275.3; 102/275.5; 102/275.6; 102/275.12; 102/312

[58] Field of Search ..... 102/275.1, 275.3, 275.4, 102/275.5, 275.6, 275.7, 275.8, 275.12, 217, 311, 312

[56] References Cited

U.S. PATENT DOCUMENTS

| | | | |
|---|---|---|---|
| 2,587,694 | 3/1952 | Chalmers et al. | 102/275.4 |
| 3,713,384 | 1/1973 | Turnbull | 102/275.7 |
| 4,187,780 | 2/1980 | Petruccelli | 102/275.12 |
| 4,481,884 | 11/1984 | Yunan | 102/275.4 |
| 4,714,017 | 12/1987 | Kelly et al. | 102/275.4 |
| 4,722,279 | 2/1988 | Yunan | 102/275.4 |
| 5,204,492 | 4/1993 | Jacob et al. | 102/275.12 |

FOREIGN PATENT DOCUMENTS 1203121 4/1986 Canada .

*Primary Examiner*—Stephen M. Johnson

*Attorney, Agent, or Firm*—Victor E. Libert; Frederick A. Spaeth

[57] ABSTRACT

A low-energy blasting initiation system, method and surface connection is disclosed for low-noise, time controlled transmission of an initiation signal from a signal initiation source to a plurality of remote blasting elements. A connector block of the system comprises a housing having a channel formed therein for receiving a low energy detonator. A tube engaging member is formed on an end of the housing for holding transmission tubes adjacent an end of the channel. Tabs are formed in the channel for snap-fit retention of the detonator, and positioning cleats are formed in the channel for positioning of the detonator with an explosive end of the detonator in juxtaposed energy communicating relationship with a side of the transmission tubes. Non-direction signal transmission is initiated in the transmission tubes in response to activation of the detonator for time-controlled transmission of the initiation signal to the remote blasting system elements.

18 Claims, 3 Drawing Sheets

LOW ENERGY BLASTING INITIATION SYSTEM, METHOD AND SURFACE CONNECTION THEREFOR

This is a continuation of application Ser. No. 07/878,735, filed May 5, 1992, now abandoned, which is a continuation of Ser. No. 07/608,993, filed Nov. 5, 1990, now U.S. Pat. No. 5,171,935.

TECHNICAL FIELD

This invention relates to apparatus for use in blasting operations, and more particularly to a non-electric, low-energy blasting initiation system having a surface connection for low-noise, time-controlled initiation of non-directional signal transmission in at least one transmission tube by a low energy detonator.

BACKGROUND OF THE INVENTION

In detonating a plurality of blasting charges in a blasting pattern it is generally required that the timing of such detonations be controlled precisely. This is true, for example, in quarry blasting where sequential delays between charges must be controlled within milli-second accuracy. In order to control such timing of charges, signal transmission lines are deployed from a central initiating point to transmit a signal to detonate the individual blasting charges. Normally, these lines consist of one or more main trunk lines connected to a plurality of down lines. Timing of the detonating signal is normally accomplished by using preselected lengths of known transmission lines and/or by delaying the signal, e.g., with a discrete signal delay unit or delay detonator, where necessary.

The manner of connection of the signal transmission lines, for example, between a trunk line and a plurality of down lines, depends on the type of transmission line utilized. Conventional combustable fuses and detonating cords may be connected by directly tying the lines together. Such fuses and cords contain a high energy explosive core that creates a loud noise during signal propagation, which noise is of particular concern to workers and when blasting near populated areas.

Non-destructing transmission tubes may also be utilized to carry a detonating signal in a blasting pattern. The transmission tube may be of the type disclosed in U.S. Pat. No. 4,607,573, often referred to as "shock tube". As used herein, the term "transmission tube" refers to any detonating or deflagrating signal transmission tube or line including a flexible hollow tube, which can carry a detonating or deflagrating signal along its interior, which signal does not destroy the tube. The term "signal" when used in connection with the aforementioned transmission tube is intended to refer to both the detonating shock wave or deflagrating flame front that is transmitted along the interior of the tube by combustion of the reactive substances contained therein. The signal moving through a transmission tube is so quiet that it can be considered "noiseless".

Transmission tubes may be connected in a blasting pattern, for example, as disclosed in U.S. Pat. No. 3,987,732. The connection block described therein holds a pair of transmission tubes in parallel relation to a detonator. The detonator contains a high energy explosive charge which detonates progressively along its length in a linear and directional fashion, thereby transferring detonating energy to the transmission tubes in a uni-directional fashion. The reaction in the transmission tubes generally proceeds in the driven direction, and not in the opposite direction, which uni-directional transmission is of concern in a blast pattern because the improper assembly of a transmission tube in a connector may direct the reaction in the wrong direction thereby to prevent reliable signal transmission to bore hole detonators.

It is a primary object of the invention to provide a low energy blasting initiation system surface connection for reliable non-directional transmission of an initiation signal to remote blasting system elements in a low-noise, time controlled manner;

It is another object of the invention to provide an improved connector block to effect the low energy blasting initiation system surface connection wherein reliable initiation of non-directional signal transmission is initiated in at least one transmission tube by a low energy detonator received in the connector block;

It is a further object of the invention to provide a connector block for easy connection of a plurality of transmission tubes in juxtaposed, energy communicating relationship with the explosive end of the low energy detonator, which connector block is inexpensive and essentially disposable;

It is another object of the invention to provide a low energy blasting initiation system connection having a connector block with a shock absorbent, protective body which minimizes shock initiated detonation of the low energy detonator contained therein and which substantially contains any shrapnel upon initiation of the low energy detonator;

It is a still further object of the invention to provide a low energy blasting initiation system having environmentally impervious component parts for easy assembly under adverse environmental conditions to reliably transmit an initiation signal to remote blasting system elements;

It is another object of the invention to provide an improved method of low-noise time controlled initiation of remote blasting system elements that is reliable under adverse environmental conditions.

Other objects will be in part obvious and in part pointed out in more detail hereinafter.

A better understanding of the objects, advantages, features, properties and relations of the invention will be obtained from the following description and accompanying drawings which set forth certain illustrative embodiments and are indicative of the various ways in which the principles of the invention are employed.

SUMMARY OF THE INVENTION

A low energy blasting initiation system surface connection according to the present invention comprises, in its preferred embodiment, a connector block having a housing with a channel formed therein for receiving and retaining a low energy detonator; and means on the housing for retention of one or a plurality of transmission tubes in juxtaposed, energy communicating relationship with an explosive end of the detonator, wherein non-directional signal transmission is initiated in the transmission tubes in response to activation of the low energy detonator for low-noise, time-controlled transmission of an initiation signal by the transmission tubes thereby relaying the initiation signal to remote blasting system elements.

In further accord with the invention, tabs are formed in the channel for snap-in retention of the detonator, and positioning cleats are formed in the channel for positioning of the low energy detonator within the channel with the detonator explosive end in juxtaposition with a side of the transmission tubes.

In still further accord with the invention, an environmentally impervious, low energy blasting initiation system and method of assembly is disclosed using the surface connection for easy and reliable assembly of the system under adverse environment conditions, which system reliably transmits an initiation signal to remote blasting system elements. The system is provided with a plurality of outgoing transmission tubes connected at one end to the remote blasting elements and having an environmental seal on an opposing end; an incoming transmission tube connected at one end to a signal initiation source and connected at an opposing end to a low energy detonator; and a housing having a channel formed therein for receiving the detonator. The detonator is inserted in the channel and retained therein and the outgoing transmission tubes are held in juxtaposed, energy communicating relationship with an end of the detonator containing an explosive composition, wherein the detonator explosive composition is initiated in response to an initiation signal transmitted from the signal initiation source within the incoming transmission tube, thereby initiating non-directional signal transmission within the outgoing transmission tubes for transmitting the initiation signal to the blasting system elements.

DESCRIPTION OF A PREFERRED EMBODIMENT

Figure 1:
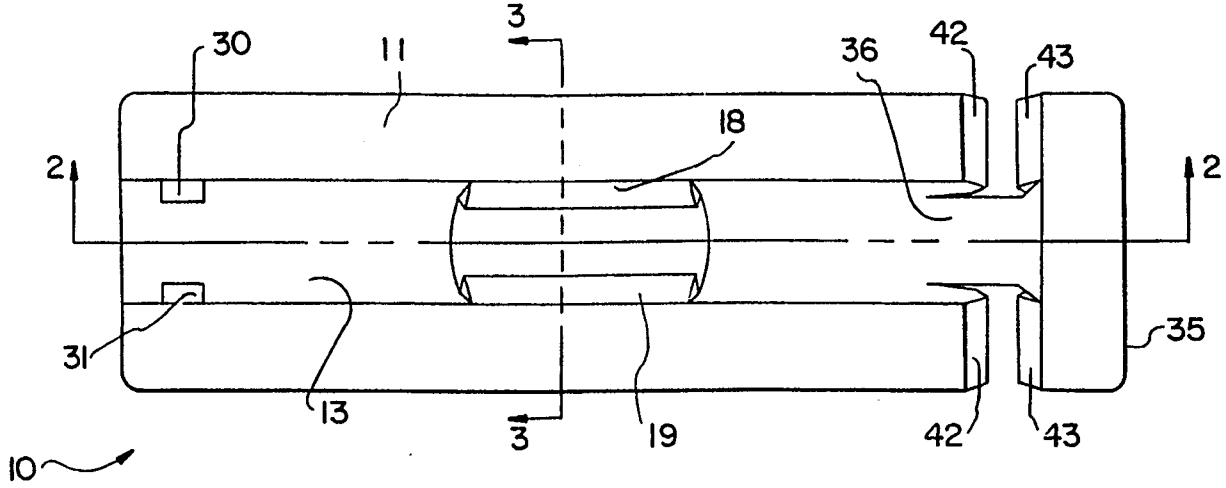
FIG. 1 is a top view of a connector block of the present invention.

The low energy blasting initiation system surface connection of the present invention is particularly well suited for reliable low-noise, time controlled transmission of an initiation signal between a signal initiation source and a plurality of remote blasting system elements. The connection of the invention is effected by an improved connector block which holds one or a plurality of transmission tubes in juxtaposed, energy communicating relationship with the explosive end of a low energy detonation.

Referring particularly to FIGS. 1, 2, 3 and 4, the connector block of the invention is generally indicated by numeral 10 and comprises a housing 11 having a channel 13 formed therein. The channel 13 is configured to receive a low energy detonator 15, and a pair of tabs 18, 19 are formed in the shape of two parallel lips within the channel to securely hold the detonator 15 within the channel. The tabs 18, 19 are configured so that the detonator may be received in the channel by snap-fit for secure retention and ease of assembly. The tabs comprise a resiliently deformable angled surface 52, 53 to effect snap-fitting the detonator in the channel.

Figure 4:
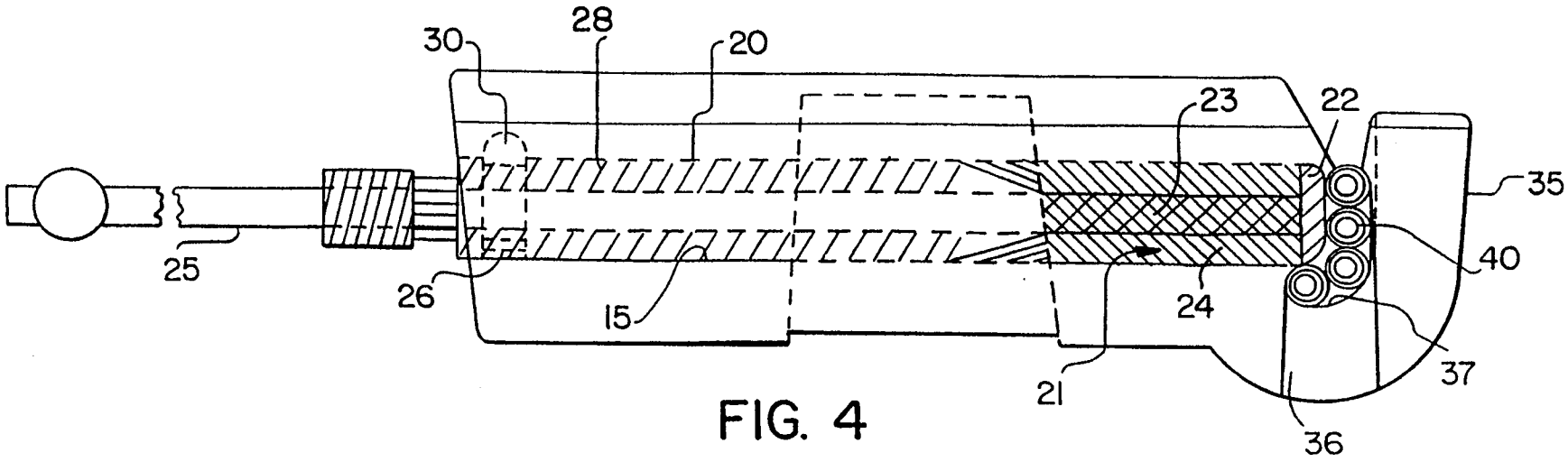
FIG. 4 is a side view of the connector block of FIG. 1 having a detonator and a plurality of transmission tubes received therein, the detonator being shown in phantom.

Referring to FIG. 4, the low energy detonator 15 may be of any type known in the art capable of transmitting an initiation signal through the side of a sealed transmission tube in response to activation of the detonator for initiation of signal transmission within the transmission tube. More particularly, the detonator comprises a cylindrical housing 20 having a closed end and further having a pyrotechnic delay element 21 and an explosive element 22 contained therein.

The delay element 21 contains a shaped delay composition 23 inside a metal tube 24, e.g., lead. The delay composition may be of any suitable type known in the art for combustion from one side of the element to the other in a time period that can be accurately predicted. Typically, only a single delay element is utilized; however, multiple delay elements may be used to achieve the desired delay time. For purposes of the present invention, the explosive element 22 is of a smaller size than contained in a typical bore hole detonator, consisting of only 1 to 2 grains of explosive, and preferably less than 5 grains of explosive, as compared to about 5 to 28 grains of explosive contained in a typical bore hole detonator.

An incoming transmission tube 25 is securely held in the end of the low energy detonator 15 preferably by a factory assembly process wherein an elastomeric bearing 28 is positioned between the tube 25 and an end of the housing 20, and a crimp 26 is placed in the end of the housing to hold the bearing 28 and tube 25. Factory assembly provides a secure and reliable connection of the tube and the housing under controlled conditions to minimize the introduction of contaminates into the tube and housing.

A pair of positioning cleats 30, 31 are formed within the channel 13 for engagement with the crimp 26 in the detonator housing for positioning of the low energy detonator 15 within the channel and retaining the detonator in an alignment position within the channel.

Referring again to FIGS. 1, 2 and 4, a tube engaging and gripping member 35 is held adjacent an end of the housing 11 by a resilently deformable segment 36. In the preferred embodiment, the housing 11, member 35 and segment 36 comprise a unitary structure for ease of construction and simplicity in design; however, the invention would work equally as well if the housing 11, member 35 and segment 36 are formed separately and joined by suitable fastening means. The housing is of a substantial size and thickness to allow capture of the shrapnel dispersed upon detonation of the detonator and for easy handling of the detonator during field assembly of a blasting system. The segment 36 is of a reduced material thickness than the housing, thereby allowing it to flex or bend under force. The segment 36 holds the member 35 a short distance from the housing 11 thereby forming a slot 37 in generally perpendicular relation to the low energy detonator 15. The positioning cleats 30, 31 function to position the low energy detonator 15 with the explosive end 22 adjacent the slot 37.

Figure 3:
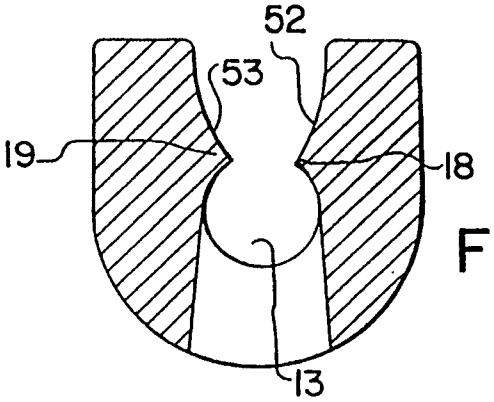
FIG. 3 is a cross-sectional view taken on line 3—3 of FIG. 1.

The width of slot 37 is slightly smaller than the outside diameter of a transmission tube 40 to securely hold each tube in juxtaposition with the detonator explosive end 22 as illustrated in FIG. 3. Retaining members 42, 43 are formed on the housing 11 and engaging member 35 at the top of slot 37 and on both sides of channel 13 for retention of transmission tubes within the slot. It will therefor be understood that although the slot 37 may be configured to receive a plurality of tubes, a single tube received therein will be securely held for reliable initiation by the low energy detonator 15.

Figure 2:
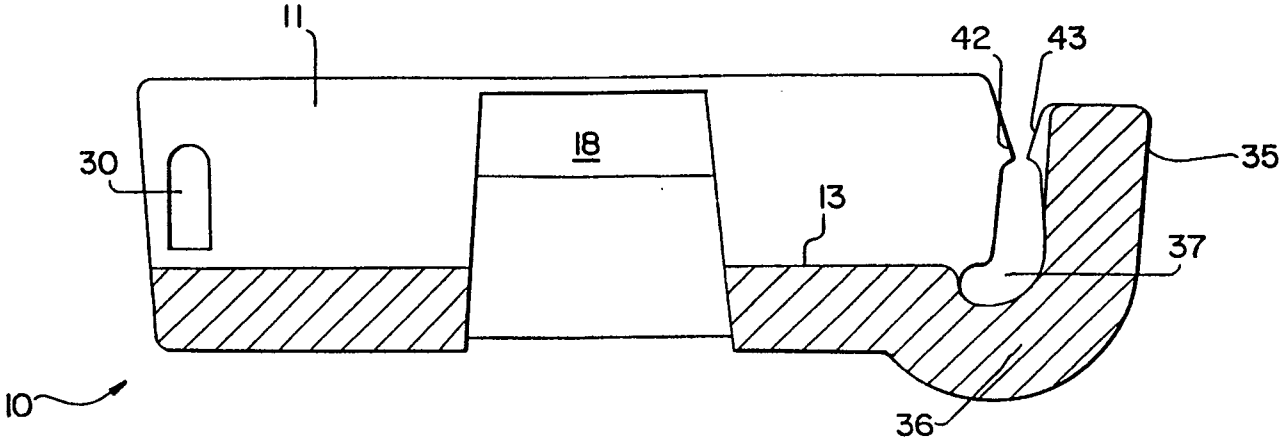
FIG. 2 is a cross-sectional view of the connector block taken on line 2—2 of FIG. 1.

As is seen from the above description, the connector block 10 provides simplified connection of the detonator 15 to blasting system transmission tubes 40 by allowing lengths of transmission tubes 40 to be positioned in the slot 37 in juxtaposition with the explosive end 22 of the detonator. As illustrated in FIGS. 2 and 4, the slot 37 may be extended at a right angle in a "J-shape" at its base becoming parallel to the detonator axis, thus producing a tangential relationship of the transmission tubes 40 to the detonator in the angled portion of the slot. This arrangement allows a greater number of transmission tubes to be inserted in the slot with the limiting factor being that each transmission tubes be in a juxtaposed energy communication relationship with a portion of the detonator containing the explosive 22.

The term "energy communication" refers to a low-energy pulse from the detonator explosive 22 which is transmitted through a side of the transmission tubes 40 and is directly communicated to the interior of the tubes for combusion of the reactive substance contained therein. The pulse is supplied upon activation of the detonator 15 to essentially a point on the tubes, and causes local initiation of signal transmission within the tubes which then propagates away from the point of initation in both directions. This non-directional point initation of the transmission tubes 40 requires only a minimum amount of explosive 22 thereby minimizing the noise generated upon activation of the detonator and generating little shrapnel upon activation of the detonator.

To effect reliable non-directional point initiation of the transmission tubes 40, the tubes 40 are preferably held in generally perpendicular relationship to the detonator 15 in the slot 37 as shown in FIG. 3; however, reliable point initiation of the tubes 40 may be effected provided that the tubes 40 are in juxtaposed energy communicating relationship with the explosive end of the detonator 15.

The connector block 10 is particularly useful for surface mounting in the low energy blasting system, and it is therefore important for the connector block to be shock absorbent to protect the detonator 15 from impact forces. Additionally, the connector block 10 will be used under a variety of climatic conditions, and it is therefore important that the resiliently deformable segment 36 not become brittle in cold conditions and not lose its strength and elasticity in hot conditions. The connector block material should also be sufficiently soft to allow the capture of the small quality of shrapnel dispersed after detonation of the detonator. The connector block is therefore preferably manufactured of a high strength, durable and shock absorbent material that maintains its resiliency over a wide range of temperatures. Suitable materials include polyolefins such as medium density polyethylene.

Figure 5:
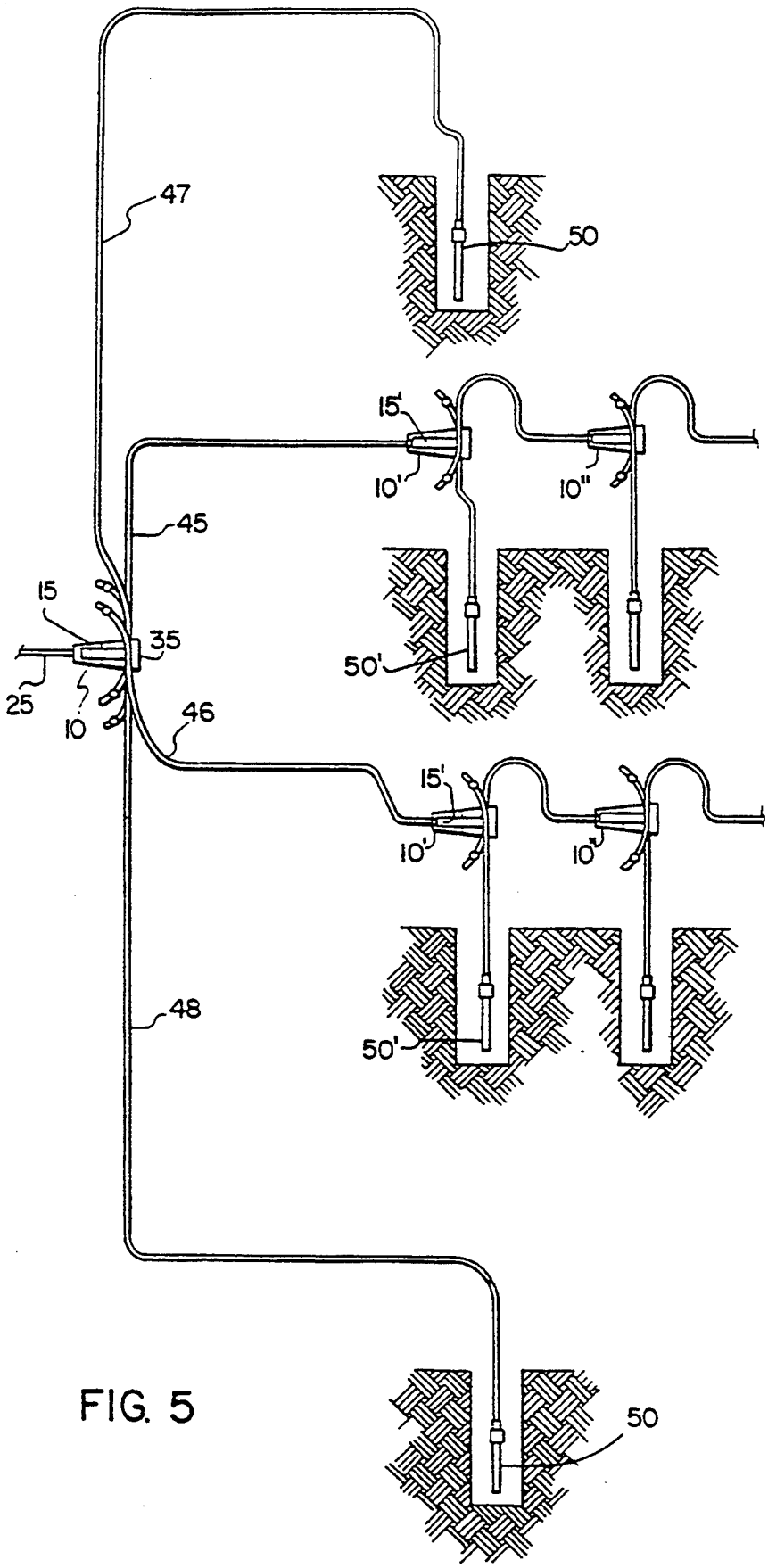
FIG. 5 is a schematic plan view of a low energy blasting initiation system using the low energy surface connection of the invention.

The operation of the connection of the invention in a low energy blasting intiation system is best understood by example. Referring to FIG. 5, connector blocks 10, 10', 10'' of the present invention are shown assembled in a complex blast pattern. A low energy detonator 15 crimped to an incomming transmission tube 25 is snap-fit into a connector block 10. Outgoing transmission tubes 45, 46, 47, 48 are held in juxtaposition with the explosive end of the low energy detonator 15 within the slot by tube engaging member 35. Each outgoing transmission tube is sealed at one end to prevent the introduction of environmental contamination, and has a remote blasting system element, e.g., a bore hole detonator 50 or a further connector block low energy detonator 15', crimped onto its other end. By providing the system component parts sealed against environmental contamination, the system may be assembled for reliable operation even under adverse environmental conditions.

The system is assembled directly on the surface, eliminating the time and expense of preparing trenches for burying the transmission tubes and connector block prior to operation of the system. The substantial body of the connector block 10 allows it to be easily handled during field assembly of the system.

The connector block low energy detonator 15 detonates in response to an initation signal transmitted from a signal initiation source (not shown) within incoming transmission tube 25 causing non-directional point initiation of the outgoing transmission tubes 45, 46, 47, 48. Each outgoing transmission tube 45, 46, 47, 48 transmits a signal along its length for direct initiation of a bore hole detonator 50 or initiation of a low energy detonator 15' in a down line connector block 10'. The down line connector block 10' may be interconnected for direct initiation of subsequent bore hole detonators 50' and/or in a relay fashion to subsequent connector blocks 10'' for relaying the initiation signal to terminal blasting system elements.

As will be understood by those skilled in the art, each connector block detonator 15, 15' and each bore hole detonator 50, 50' may contain a delay element between the detonator explosive composition and the transmission tube received in the detonator. The length of the delay element time delay for each detonator will be selected to effect the desired blasting sequence.

Although the invention has been illustrated and described with respect to an exemplary embodiment thereof, it should be understood by those skilled in the art that various other changes, ommissions and additions may be made therein and thereto, without departing from the spirit and scope of the invention.

We claim:

1. A low energy blasting initiation system surface connector block for retaining a low energy detonator having an explosive end and used to initiate non-directional signal transmissions in one or more transmission tubes having respective transmission tube longitudinal axes and outside diameters, the connector block comprising:

a housing having a channel formed therein, the channel having a longitudinal axis and being dimensioned and configured for receiving the detonator as defined above with the explosive end of the detonator adjacent one end of said channel;

a resiliently deformable segment having a first end and an opposite end and being fixed at said first end to said housing, at least a portion of said segment being of a reduced thickness relative to the thickness of said housing;

a tube engaging and gripping member fixed to the opposite end of said segment to form a slot between said housing and said member, said slot being disposed at said one end of said channel, said slot being of arcuate cross section and being dimensioned and configured to receive and retain therein the one or more transmission tubes disposed within said slot adjacent said one end of said channel, with the longitudinal axes of at least those portions of the one or more transmission tubes disposed within said slot being retained perpendicularly to respective lines taken parallel to the longitudinal axis of said channel and intersecting respective transmission tube longitudinal axes, said segment deforming in response to force exerted on said member for positioning the one or more transmission tubes in said slot; and positioning means on said housing for positioning the detonator within said channel with the explosive end of the detonator in juxtaposed energy communicating relationship with the slot whereby activation of the explosive end of the detonator so positioned in said channel initiates non-directional signal transmission in the one or more transmission tubes retained in said slot.

2. The connector block of claim 1 wherein said slot extends both perpendicularly and parallel to said channel at said one end thereof.

3. The connector block of claim 2 further comprising the low energy detonator disposed in the channel whereby said slot extends both perpendicularly and parallel to the explosive end of the detonator.

4. The connector block of claim 3 further comprising the one or more transmission tubes retained in said slot in juxtaposed energy communicating relationship with the explosive end of said detonator.

5. The connector block of claim 1 wherein said housing, said tube engaging and gripping member and said segment comprise a unitary structure.

6. The connector block of claim 1 further comprising retaining members formed on said tube engaging and gripping member and said housing for retention of the one or more transmission tubes within said slot.

7. The connector block of claim 1 wherein the low energy detonator contains less than five (5) grains of explosive.

8. The connector block of claim 1 wherein said slot has a width slightly smaller than the transmission tube outside diameter.

9. The connector block of claim 1 further comprising the low energy detonator disposed in the channel.

10. The connector block of claim 9 further comprising the one or more transmission tubes retained in said slot in juxtaposed energy communicating relationship with the explosive end of said detonator.

11. A low energy blasting initiation system surface connector block for retaining a low-energy detonator having a crimp formed therein and an explosive end and used to initiate non-directional signal transmission in one or more transmission tubes having respective transmission tube outside diameters, the connector block comprising:

a housing having a channel formed therein for receiving the detonator, said housing being of a substantial thickness and size for ease of handling;

a resiliently deformable segment having a first end and an opposite end and being fixed at said first end to said housing, at least a portion of said segment being of a reduced thickness relative to said housing;

a tube engaging and gripping member fixed to the opposite end of said segment to form a slot between said housing and said member, said slot being of arcuate cross section and dimensioned and configured to receive and retain a plurality of said transmission tubes, said segment deforming in response to force exerted on said member for positioning the transmission tubes in said slot;

positioning means on said housing for positioning the detonator within said channel with the explosive end of the detonator in juxtaposed energy communicating relationship with the one or more transmission tubes whereby activation of the detonator explosive end initiates non-directional signal transmission within the transmission tubes;

said block further comprising resiliently deformable tabs formed on said housing within said channel for snap-in retention of the detonator within said channel, and wherein said positioning means comprises positioning cleats formed on said housing within said channel for engagement with the crimp in the detonator.

12. A method of initiating a plurality of remote blasting signal communicating elements with a low energy blasting initiation system wherein an initiation signal is transmitted in a low-noise, time controlled manner from a signal initiation source to the remote elements, the method comprising the steps of:

providing a plurality of outgoing transmission tubes communicating at one end with the blasting elements and having an environmental seal on an opposing end;

providing an incoming transmission tube communicating at one end with the signal initiation source and communicating at an opposing end with a low energy detonator having an explosive composition therein located at an explosive end thereof; and arranging said outgoing transmission tubes in side-by-side relationship with one another and in juxtaposed energy communicating relationship with, and in an arcuate array about, said explosive end of said detonator whereby activation of said detonator explosive composition initiates non-directional signal transmission within said outgoing transmission tubes for transmitting the initiation signal to the remote elements.

13. A low energy blasting initiation system surface connector block for retaining a low energy detonator having an explosive end and used to initiate non-directional signal transmissions in one or more transmission tubes having respective transmission tube longitudinal axes, the connector block comprising:

a housing having a channel formed therein, the channel having a longitudinal axis and being dimensioned and configured for receiving a detonator as defined above with the explosive end of the detonator adjacent one end of said channel;

means on the housing for retention of said one or more transmission tubes thereon, said means comprising a slot of arcuate cross section disposed at said one end of said channel, said arcuate slot being dimensioned and configured to extend perpendicularly and parallel to said channel at said one end thereof and to receive and retain therein said one or more transmission tubes, the longitudinal axes of at least the portions of said tubes disposed within said slot being disposed perpendicularly to respective lines taken parallel to the longitudinal axis of the channel and intersecting respective transmission tube longitudinal axes; and positioning means on said housing for positioning the detonator within said channel with the explosive end of the detonator in juxtaposed energy communicating relationship with said slot whereby activation of the detonator explosive end initiates non-directional signal transmission within the one or more transmission tubes retained within said slot.

14. The connector block of claim 13 in combination with the low energy detonator disposed in the channel, whereby the arcuate slot extends both perpendicularly and parallel to the explosive end of the detonator.

15. The connector block of claim 13 further including a segment having a first end and an opposite end and being fixed at said first end to said housing, at least a portion of said segment being of a reduced thickness relative to the thickness of said housing, and wherein said slot is defined by means comprising a tube engaging and gripping member fixed to the opposite end of said segment to form said slot between said housing and said member.

16. The connector block of claim 13 further comprising the low energy detonator disposed in the channel whereby said slot extends both perpendicularly and parallel to the explosive end of the detonator.

17. The connector block of claim 16 further comprising the one or more transmission tubes retained in said slot in juxtaposed energy communicating relationship with the explosive end of said detonator.

18. A low energy blasting initiation system surface connector block for retaining a low energy detonator having a crimp formed therein and an explosive end, and used to initiate non-directional signal transmissions in one or more transmission tubes, the connector block comprising:

a housing having a channel formed therein for receiving a detonator as defined above, said block including resiliently deformable tabs formed on said housing within said channel for snap-in retention of the detonator within said channel;

means on the housing for retention of the one or more transmission tubes therein, said means comprising a slot of arcuate cross section which is dimensioned and configured to receive and retain therein said one or more transmission tubes; and positioning means on said housing comprising positioning cleats formed on said housing within said channel for positioning the detonator within said channel for engagement with the crimp in the detonator, the positioning means serving to position the detonator within said channel with the explosive end of the detonator in juxtaposed energy communicating relationship with the one or more transmission tubes received and retained within said slot whereby activation of the detonator explosive end initiates non-directional signal transmission within the one or more transmission tubes so retained.

* * * * *

UNITED STATES PATENT AND TRADEMARK OFFICE

CERTIFICATE OF CORRECTION

PATENT NO. : 5,398,611

DATED : March 21, 1995

INVENTOR(S) : Richard J. Michna et al

It is certified that error appears in the above-indentified patent and that said Letters Patent is hereby corrected as shown below:

In The Abstract

In line 15, replace "direction" with --directional--.

In column 1, line 6, between "of" and "application" insert --copending--.
In column 1, line 38, replace "combustable" with --combustible--.
In column 4, line 32, replace "contaminates" with --contaminants--.
In column 4, line 41, replace "resilently" with --resiliently--.
Column 4, line 67, replace "therefor" with --therefore--.
In column 5, line 15, replace "tubes" with --tube--.
In column 5, line 22, replace "combusion" with --combustion--.
In column 5, line 27, replace "initation" with --initiation--.
In column 5, line 28, replace "initation with --initiation--.
In column 5, line 51, replace "quality" with --quantity--.
In column 5, line 52, replace "dispursed" with --dispersed--.
In column 5, line 59, replace "intiation" with --initiation--.
In column 5, line 63, replace "incomming" with --incoming--.
In column 6, line 39, replace "ommissions" with --omissions--.

Signed and Sealed this

Seventh Day of November, 1995

Bruce Lehman

*Attest:*

BRUCE LEHMAN

*Attesting Officer*

*Commissioner of Patents and Trademarks*